US006154994A

United States Patent [19]

O'Brien et al.

[11] Patent Number: 6,154,994

[45] Date of Patent: Dec. 5, 2000

[54] PORTABLE ILLUMINATED SIGN

[76] Inventors: Eric G. O'Brien, 171 Autumn Trail, Ringold, Ga. 30736; Kris D. Hanon, 169 Springfield Blvd., Macon, Ga. 31210; Kenneth D. Neal, 5225 Silver La., Collegedale, Tenn. 37302

[21] Appl. No.: 09/285,797

[22] Filed: Apr. 5, 1999

[51] Int. Cl.[7] ..... G09F 13/04; G09F 21/02

[52] U.S. Cl. ..... 40/575; 40/586; 40/574; 362/812

[58] Field of Search ..... 40/564, 573, 574, 40/575, 591, 593, 597, 586, 716; 362/103, 108, 812

[56] References Cited

U.S. PATENT DOCUMENTS

| | | | |
|---|---|---|---|
| 2,320,193 | 5/1943 | Powell et al. | 362/108 |
| 2,766,540 | 10/1956 | Brown et al. | 40/574 |
| 4,452,000 | 6/1984 | Gandy | 40/574 |
| 4,860,476 | 8/1989 | Hall | 40/591 X |
| 4,893,221 | 1/1990 | Friedman | 362/108 |
| 4,903,423 | 2/1990 | Hinca | 40/574 X |
| 4,905,390 | 3/1990 | Stilling | 40/574 X |
| 5,007,190 | 4/1991 | Shyu | 40/564 |
| 5,025,355 | 6/1991 | Harwood | 40/553 X |
| 5,131,177 | 7/1992 | Sy, Jr. | 40/591 X |
| 5,237,766 | 8/1993 | Mikolay | 40/564 |
| 5,379,540 | 1/1995 | Howard | 40/573 X |
| 5,600,909 | 2/1997 | Hooper | 40/558 |
| 5,636,462 | 6/1997 | Kleiman | 40/452 |
| 5,678,334 | 10/1997 | Schöniger | 40/546 |
| 5,682,697 | 11/1997 | Hjaltason | 40/615 |
| 5,815,969 | 10/1998 | Brouwer | 40/574 |

FOREIGN PATENT DOCUMENTS

| | | | |
|---|---|---|---|
| 728829 | 12/1931 | France | 40/597 |
| 2577489 | 8/1986 | France | 40/591 |

*Primary Examiner*—Brian K. Green
*Attorney, Agent, or Firm*—Richard C. Litman

[57] ABSTRACT

A portable lightweight illuminated sign assembly for either carrying on one's person or placing on a window for advertisement and the like. The plastic housing is rectangular in shape to support a rectangular transparent plastic face plate which carries a message illuminated by at least one fluorescent light source and energized by either a D.C. source when portable and by either D.C. or A.C. current when affixed to a window. Suction cups attachable to loops or hooks are provided on the housing adjacent to the face plate for affixing to a window. A hook element positioned on the housing on both sides and centered between the attachment loops or hooks enables the use of body straps for supporting the portable sign assembly on one's torso.

8 Claims, 3 Drawing Sheets

PORTABLE ILLUMINATED SIGN

BACKGROUND OF THE INVENTION

1. Field of the Invention

The present invention relates to a portable or affixed illuminated sign. More specifically, the invention relates to a portable illuminated sign for carrying on one's torso for a parade and the like. The illuminated sign can be affixed to a shop window for advertisement.

2. Description of the Related Art

The related art of interest describes various portable illuminated signs, but none show the present invention. The related art of interest will be discussed in the order of perceived interest to the present invention.

U.S. Pat. No. 4,903,423 issued on Feb. 27, 1990, to William A. Hinca describes a fixed sign holder having a frame comprising sidewalls and a rear wall holding two removable transparent panels in grooves, wherein the inside second panel has indicia on it and a light bulb behind it. A top cover is removable and fastenable to the frame at its sidewalls. The sign can be mounted on an automobile bumper or a house by utilizing a pair of apertures in the rear wall. The sign holder is distinguishable for its significantly different structure employing two transparent panels.

U.S. Pat. No. 4,452,000 issued on Jun. 5, 1984, to James Gandy describes a fixed illuminatable sign comprising an extruded aluminum housing or a sheet metal housing having an open front and containing a series of staggered fluorescent light tubes. A top-hinged front frame holds a polyester reinforced vinyl film which is translucent white with graphics provided by spraying, silk screening or a heat transfer process. The sign is distinguishable for its critical use of a vinyl film and a stand alone housing.

U.S. Pat. No. 4,905,390 issued on Mar. 6, 1990, to Johann Stilling describes a fixed sign box for an illuminated sign made from extruded aluminum with at least one translucent panel made from an inflexible acrylic sheet or a flexible vinyl sheet with the graphics provided by the same processes as in the previous patent. There can be two translucent panels to form a double-faced sign. Two fluorescent light tubes are positioned horizontally in the rectangular housing. The box frame can consist of one to three contiguous sections. The sign box is distinguishable for its extruded aluminum structure requiring numerous junctions.

U.S. Pat. No. 5,237,766 issued on Aug. 24, 1993, to Ray M. Mikolay describes a fixed illuminated sign with either an integrated housing or in parts with four side portions. In the first embodiment, four fluorescent tubes backed by individual reflectors in the rear of the housing supply the illumination for an internal lenticular sign panel and an external transparent and/or translucent sign panel. The internal sign panel has cutouts in a black aluminum pane. The outer panel has a white background with identical colored indicia. The second embodiment utilizes only two fluorescent tubes. The inner sign panel diffuses the light to give the appearance of a light source being at the front of the external message carrying panel. The housing has two hangers on the upper rear portion of the housing of the sign for advertising beer. The hanging sign is distinguishable for its requirement for the inner lenticular sign panel.

U.S. Pat. No. 5,600,909 issued on Feb. 11, 1997, to Steve A. Hooper describes an illuminated and changeable message display device. A rectangular housing has either a single message box or double-sided message boxes centered or off-centered in front of four or eight colored fluorescent tubes in the housing reflected by a mirror and a diffusion panel. The display can be open or covered with a weather shield. The display can be free standing or suspended and arranged horizontally or vertically. The non-mobile display is distinguishable for its separate advertising box.

U.S. Pat. No. 5,636,462 issued on Jun. 10, 1997, to Robert M. Kleiman describes an illuminated flashing light emitting diodes (LED) message display sign apparatus with a hinged and suction cupped base offering different operative positions. The display sign apparatus is distinguishable for its hinged base and LED display.

U.S. Pat. No. 5,678,334 issued on Oct. 21, 1997, to Karl Heinz Schoniger describes an enclosed lighted transparent display board made of acrylic plastic or glass. A rectangular frame houses a series of LED's around the plexiglass or glass panel. A display panel with indicia is positioned on a self-adhesive opacifier or clouding film in front of the centered display board, and a rear cover is a mirror. The external display panel may have timetables, announcements, notices, advertising texts, advertising graphics as either a road sign or an informative sign. Other embodiments include a plate with the opacifier and an opacifier film disposed between two panels. The LED illuminated display board is distinguishable for its requirement for LED illumination and an opacifier film.

U.S. Pat. No. 5,682,697 issued on Nov. 4, 1997, to Thorgeir D. Hjaltason describes a sign plate made of acrylic plastic for an illuminated sign with an opaque reflective layer (milky white plastic) covering its rear surface. The sign portion consists of a printed fluorescent layer on a light diffusion layer formed in a broken zone of the white plastic layer. The front surface of the sign plate has discrete regions of a front color layer (colored polyvinyl chloride adhesive foil) on a reflective layer. Another embodiment includes two acrylic plastic plates with a reflective areas between them. The sign plate can be illuminated by any light source. The sign plate is distinguishable for the limitation only to the composition of the sign plate having discrete areas of color and fluorescent regions on both sides of the sign plate.

None of the above inventions and patents, taken either singularly or in combination, is seen to describe the instant invention as claimed. Thus, an illuminated sign solving the aforementioned problems of being capable of being both portable and affixable is desired.

SUMMARY OF THE INVENTION

The present invention is directed to a portable lightweight illuminated sign assembly for either carrying on one's person or placing on a business window for advertisement and the like. The plastic housing is rectangular in shape to support a rectangular transparent plastic face plate which carries a message illuminated by a fluorescent light source and energized by either battery when portable and by either battery or house current when affixed to a window. Suction cups attachable to loops are provided on the housing adjacent to the face plate for affixing to a window. A hook element positioned on the housing on both sides and centered between the attachment loops enables the use of body straps for supporting the portable sign assembly on one's torso.

Accordingly, it is a principal object of the invention to provide a portable or stationary illuminated sign.

It is another object of the invention to provide a portable sign which can be carried by a person in front or in back.

It is a further object of the invention to provide a sign with indicia on a translucent face plate illuminated by a fluorescent light source.

Still another object of the invention is to provide a sign for placement on a glass window by suction cups.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to an illuminated sign with a message for use either on a person or in a business or home window. It should be noted that in FIG. 1 the sign is viewed from above, in FIG. 2 the sign is viewed from below, and in FIG. 3 the sign is viewed from below.

Figure 1:
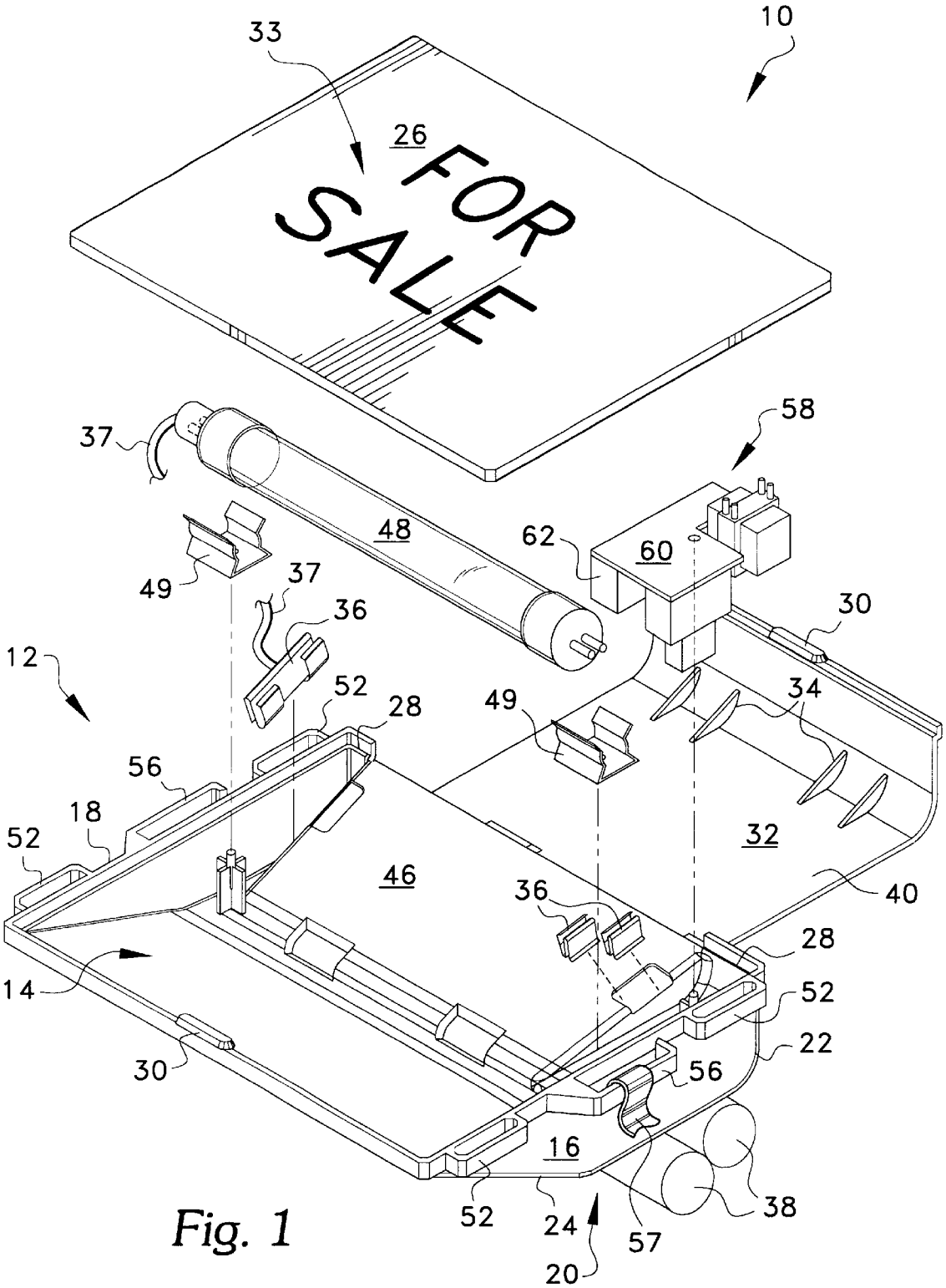
FIG. 1 is an exploded top perspective view of a portable illuminated sign according to the present invention.
Figure 2:
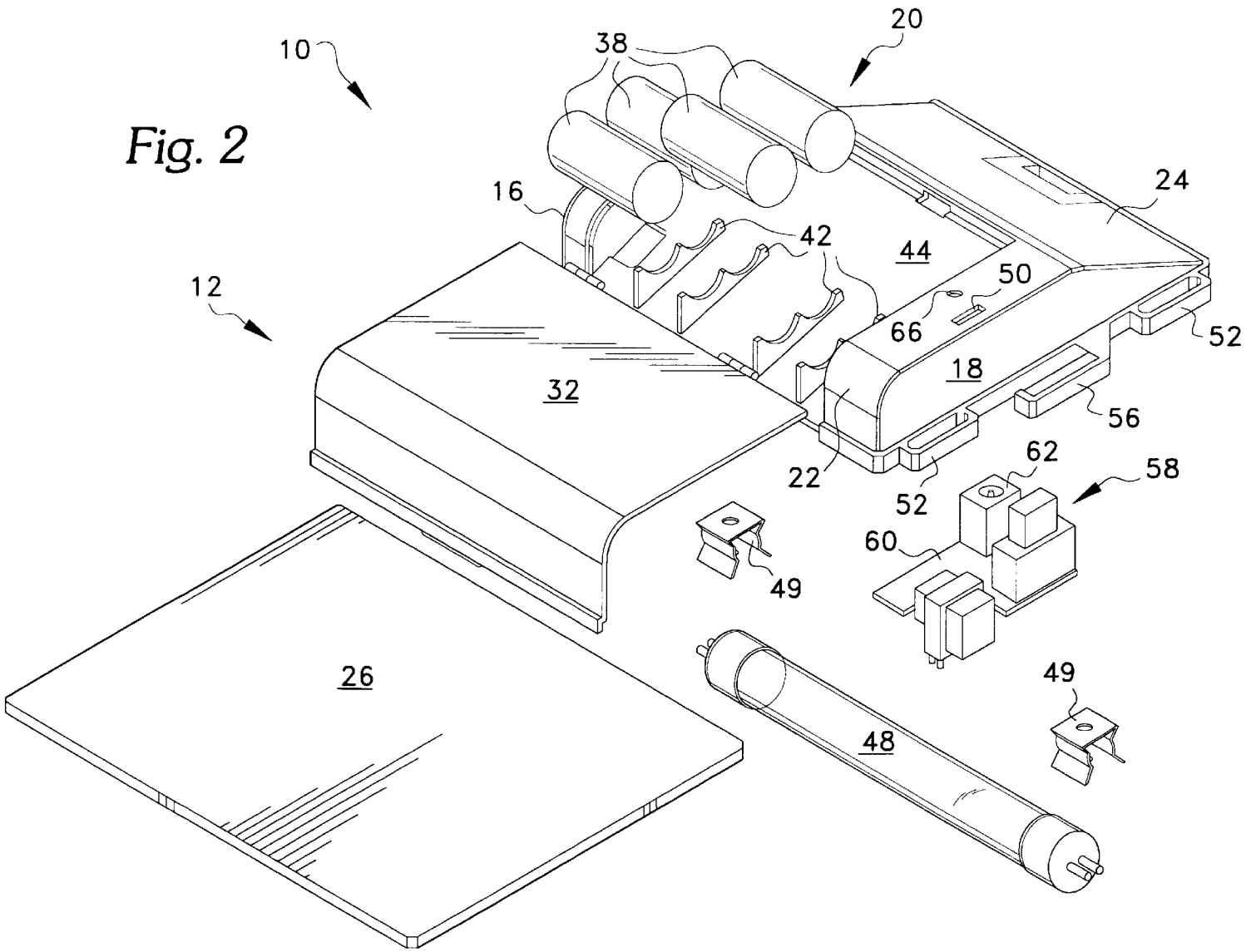
FIG. 2 is an exploded rear perspective view of the FIG. 1 invention.

In the exploded view of FIG. 1, the illuminated sign 10 comprises a rectangular plastic housing 12 having an open front region 14, a flattened right side 16, a flattened left side 18, and a generally planar rear side 20 and a top side 22 joined by a curved portion, and a limited flattened front side 24. A thin rectangular translucent plastic face plate 26 having indicia 33, e.g., "FOR SALE", is removably attachable to and covers the open front region 14 of the housing 12. The face plate 26 is supported by the shoulders 28 and the knobs 30 on the housing 12 and on the battery cover 32. The indicia 33 on the face plate 26 can be printed or painted letters, numerals, caricatures, scenery, and the like.

The curvilinear removable plastic battery cover 32 is adapted to snugly fit the generally planar rear side 20 and the top side 22 of the housing 12. Two pairs of crescent shaped battery braces 34 with battery contact clips 36 with electrical wiring 37 for the four batteries 38 (two batteries are hidden) are located on the underside surface 40 of the battery cover 34 (FIG. 1). Two pairs of battery supports 42 are located on the underside 44 of the reflector panel 46.

The reflector panel 46 having a shiny painted, silvered or aluminizes surface is positioned proximate to the top side 22 and inclined at an angle down to the rear side 20 of the housing 12. An illumination means, at least one fluorescent tube or bulb 48, with electrical wiring 37 (FIG. 1) is attached by brackets 49 to the reflector panel 46 and energized by the batteries 38. A larger sign would of necessity require a plurality of fluorescent bulbs 48. An on/off electrical switch 50 (FIG. 2) is provided on rear side 20 for manually controlling the illumination of the fluorescent bulb 48.

A pair of loops 52 for the insertion of suction cups 54 with adapter brackets 55 (FIG. 3) are positioned on the right side 16 and the left side 18 of the housing 12. The attachment means can also be first hooks instead of loops. This provision permits the positioning of the illuminated sign 10 on a window of a vehicle or a business establishment for advertisement or in a dwelling for decoration. A second hook element 56 is positioned between each pair of loops or first hooks 52 on the housing 12. This provision permits the positioning of the illuminated sign 10 on a person marching in a band and the like with body straps 57 (FIG. 1).

Figure 3:
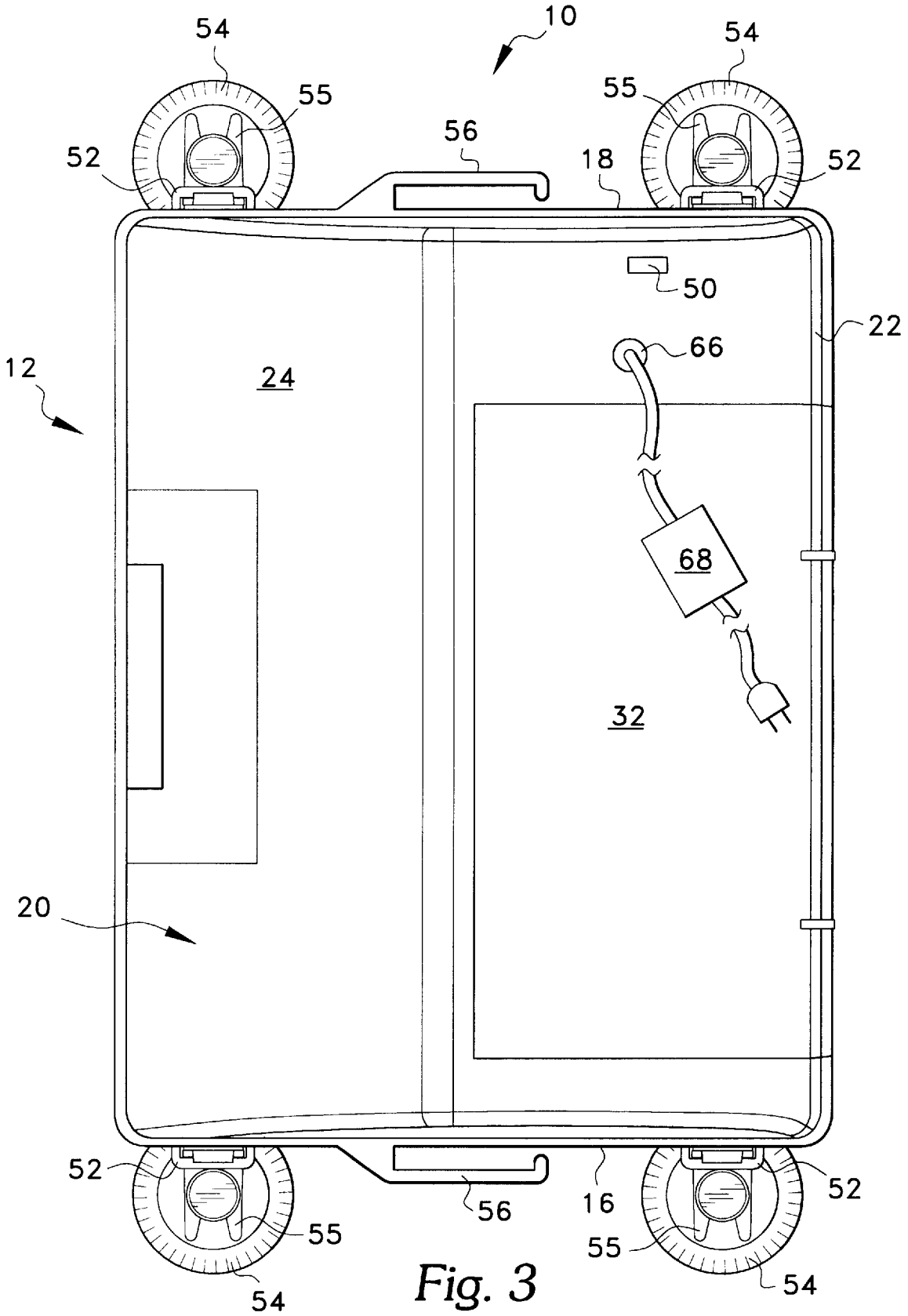
FIG. 3 is a top plan view of the stationary display sign having suction cups for attachment to a transparent surface such as a window.

Other required paraphernalia required to attach and energize the fluorescent tube 48 in the housing 12 are an electronic ballast 58 (containing a programmed circuit board 60 and an electrical power jack 62) and brackets 64. The illuminated sign 10 can be electrically powered by either an electrical adapter connected by input terminal 66 to a 12 volt D.C. battery in a vehicle or to a 110 volt A.C. house current source by an AC-DC converter and plug 68 (FIG.3.).

Thus, an economical illuminated sign powered by batteries and suitable for carrying on a person or positioned in a window of a vehicle, a business establishment, a home, and the like has been shown.

It is to be understood that the present invention is not limited to the embodiments described above, but encompasses any and all embodiments within the scope of the following claims.

We claim:

1. A portable illuminated sign comprising:

a rectangular plastic housing having an open front region, a flattened right side, a flattened left side, a generally planar rear side and a top side joined by a curved portion, and a limited flattened front side;

a thin rectangular translucent plastic face plate with indicia removably attachable to and covering the open front region of the housing;

a generally planar removable plastic cover with a curved portion adapted to snugly fit the rear side and the top side of the housing;

a flat rectangular reflector panel having a shiny surface positioned proximate to the top side and inclined at an angle down to the rear side of the housing;

an illumination means with electrical wiring attached to the reflector panel and energized by an electrical source;

an on/off electrical switch for manually controlling the illumination means;

a pair of fastener elements selected from the group consisting of loops and first hooks on each of the right side and the left side of the housing; and a second hook element positioned between each pair of loops or first hooks on the housing;

whereby the illuminated sign can be positioned on the torso of a person or against a window.

2. The illuminated sign according to claim 1, including body straps attached to the second hook elements for supporting the portable illuminated sign on one's torso.

3. The illuminated sign according to claim 1, including suction cups attached to the fastener elements selected from the group consisting of loops and first hooks provided on the housing for positioning against a window in a location selected from the group consisting of a vehicle, business and a home.

4. The illuminated sign according to claim 3, including adapter brackets to connect the suction cups to the loops.

5. The illuminated sign according to claim 1, wherein the electrical source is a plurality of D.C. batteries.

6. The illuminated sign according to claim 1, wherein the electrical source is alternating current.

7. The illuminated sign according to claim 1, wherein the illumination means is at least one fluorescent bulb.

8. The illuminated sign according to claim 7, including an electronic ballast, a programmed circuit board and an electrical power pack to energize the at least one fluorescent bulb.

* * * * *